US010096270B2

(12) United States Patent
Emoff

(10) Patent No.: US 10,096,270 B2
(45) Date of Patent: Oct. 9, 2018

(54) REMOVABLE DISPLAY SYSTEM

(71) Applicant: Outta The Box Dispensers, LLC, Dayton, OH (US)

(72) Inventor: Michael J. Emoff, Dayton, OH (US)

(73) Assignee: Outta The Box Dispensers, LLC, Dayton, OH (US)

( * ) Notice: Subject to any disclaimer, the term of this patent is extended or adjusted under 35 U.S.C. 154(b) by 24 days.

(21) Appl. No.: 15/053,623

(22) Filed: Feb. 25, 2016

(65) Prior Publication Data

US 2017/0249876 A1 Aug. 31, 2017

(51) Int. Cl.
*G09F 7/18* (2006.01)
*G09F 15/00* (2006.01)

(52) U.S. Cl.
CPC ..... *G09F 7/18* (2013.01); *G09F 15/0006* (2013.01)

(58) Field of Classification Search
CPC ..... G09F 7/18; G09F 15/0006
See application file for complete search history.

(56) References Cited

U.S. PATENT DOCUMENTS 2,964,233 A * 12/1960 McFarland ..... B42D 15/08 206/216
3,270,949 A * 9/1966 Hillman, II ..... B42D 15/08 229/92.1
3,270,950 A * 9/1966 Donovan ..... B42D 15/08 229/92.1
3,471,958 A * 10/1969 Westin ..... G09F 21/04 40/124.15
4,161,074 A * 7/1979 DePinna ..... G09F 3/204 40/124.05
4,179,138 A * 12/1979 Bogdanovic ..... G09F 1/06 248/222.12
4,643,452 A * 2/1987 Chang ..... B42D 15/02 283/62
5,628,858 A * 5/1997 Petrou ..... B65C 1/00 156/247
5,853,836 A * 12/1998 Zoss ..... B65D 85/671 40/312
6,182,393 B1 * 2/2001 Weder ..... A01G 5/04 206/423
6,261,658 B1 * 7/2001 Schmidt ..... G09F 1/14 283/81
6,360,465 B1 * 3/2002 Simpson ..... G09F 3/204 40/638
6,508,900 B1 * 1/2003 Kendall ..... B42D 15/006 156/226
8,763,288 B2 7/2014 Emoff
(Continued)

*Primary Examiner* — Charles A Fox
*Assistant Examiner* — Christopher E Veraa
(74) *Attorney, Agent, or Firm* — Walters & Wasylyna LLC

(57) ABSTRACT

A display system may include a decal including a substrate layer, and a removable adhesive layer applied to the substrate layer, the removable adhesive layer being capable of forming a temporary adhesive bond between the substrate layer and a support surface, and a folded display including a first panel connected to a second panel along a seam, a first tab connected to the first panel along a first side edge, a second tab connected to the second panel along a second side edge, and a permanent adhesive material applied to the first tab and the second tab, the permanent adhesive material being capable of forming a permanent adhesive bond between the tabs and the substrate layer.

20 Claims, 7 Drawing Sheets

(56) References Cited

U.S. PATENT DOCUMENTS

| | | | | |
|---|---|---|---|---|
| 9,177,490 | B2 | 11/2015 | Emoff | |
| 2003/0136036 | A1* | 7/2003 | Zubli | G09F 1/04 40/124.15 |
| 2005/0000129 | A1* | 1/2005 | Douziech | G09F 7/12 40/594 |
| 2006/0011643 | A1 | 1/2006 | Emoff et al. | |
| 2006/0162205 | A1* | 7/2006 | Cooper | G09F 7/00 40/594 |
| 2013/0240557 | A1* | 9/2013 | Emoff | G07B 7/00 221/199 |
| 2013/0277246 | A1* | 10/2013 | Glass | B65D 73/0078 206/232 |
| 2014/0215869 | A1* | 8/2014 | Emoff | G09F 1/04 40/124.14 |

* cited by examiner

REMOVABLE DISPLAY SYSTEM

FIELD

The present disclosure is generally related to advertisement displays and, more particularly, to removable display systems that include a decal display that is removably attached to a support surface and a foldable display that is permanently attached to the decal.

BACKGROUND

Placard advertising, particularly outdoor placard advertising, is well known in the art as an effective way to advertise products at point-of-sale and other similar locations. For example, with the advent of "pay at the pump" systems, such as those seen at gas stations, consumers equipped with a credit card have little or no reason to enter the convenience mart or other store typically accompanying the gas station. The use of placard advertising at the pump may provide an enticement to lure the consumer from the pump and into the convenience mart. Use of a coupon dispenser in conjunction with the placard advertising may provide additional enticement to the consumer.

One disadvantage to such placard advertisements is that they must be attached to a support surface in such a manner as to allow simple and secure attachment, while also being able to prevent undesired detachment. Typically, permanent adhesives are used to securely attach placard advertisements to support surfaces. However, when it comes time to remove such placard advertisements, the adhesive frequently leaves residue that is very difficult to remove.

Accordingly, those skilled in the art continue with research and development efforts in the field of placard advertisements and displays.

SUMMARY

In one example, the disclosed display system may include a decal removably attachable to a support surface, and a folded display attachable to the decal.

In another example, the disclosed display system may include a decal including a substrate layer including a first surface and a second surface opposite the first surface, and a removable adhesive material applied to at least a portion of the first surface, the removable adhesive material being capable of forming a temporary adhesive bond between the substrate layer and a support surface upon contact, and a folded display including a first panel connected to a second panel along a seam, the first panel including a first side edge opposite the seam, and the second panel including a second side edge opposite the seam, a first tab connected to the first panel along the first side edge, a second tab connected to the second panel along the second side edge, and a permanent adhesive material applied to at least a portion of the first tab and the second tab, the permanent adhesive material being capable of forming a permanent adhesive bond between the tabs and the second surface of the substrate layer upon contact.

In another example, the disclosed display system may include a support surface, a decal removably attached to the support surface, the decal including a substrate layer including a first surface and a second surface opposite the first surface, and a removable adhesive material applied to at least a portion of the first surface, the removable adhesive material forming a temporary adhesive bond between the substrate layer and the support surface, and a folded display permanently attached to the decal, the folded display including a first panel connected to a second panel along a seam, the first panel including a first side edge opposite the seam, and the second panel including a second side edge opposite the seam, a first tab connected to the first panel along the first side edge, a second tab connected to the second panel along the second side edge, and a permanent adhesive material applied to at least a portion of the first tab and the second tab, the permanent adhesive material forming a permanent adhesive bond between the tabs and the second surface of the substrate layer.

Other examples of the disclosed display system will become apparent from the following detailed description, the accompanying drawings and the appended claims.

DETAILED DESCRIPTION

Figure 1:
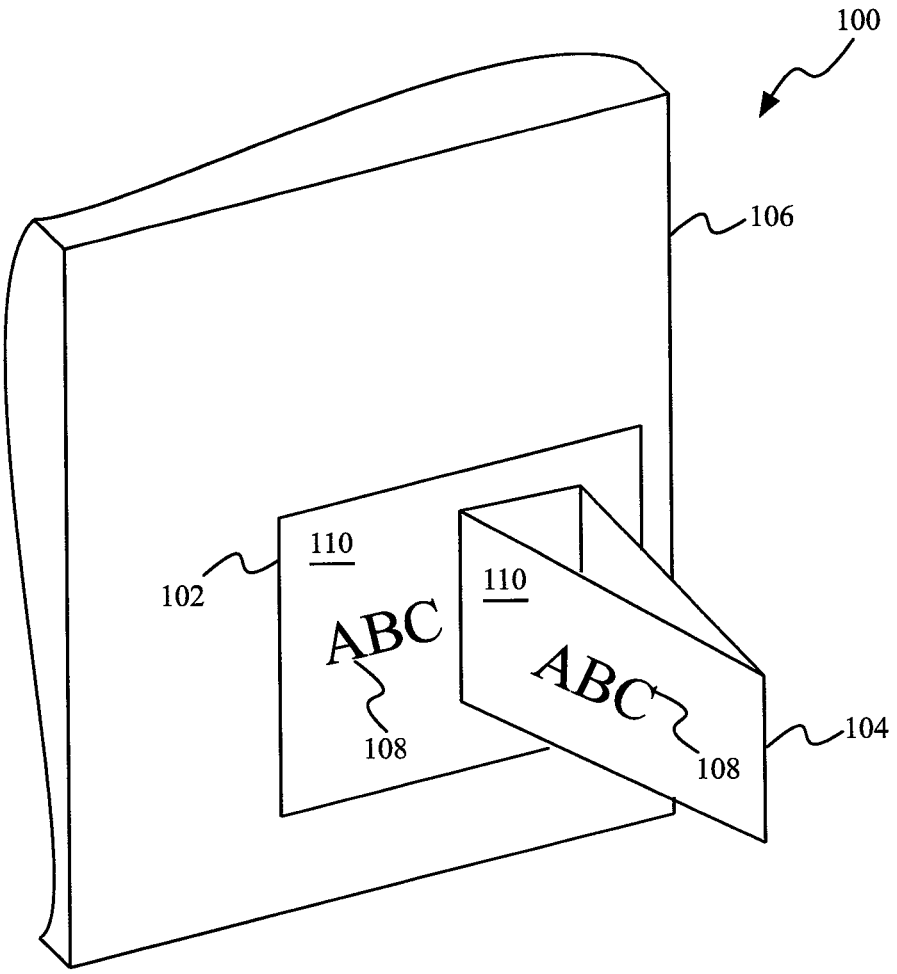
FIG. 1 is a schematic isometric view of one example of the disclosed display system.

The following detailed description refers to the accompanying drawings, which illustrate specific examples described by the disclosure. Other examples having different structures and operations do not depart from the scope of the present disclosure. Like reference numerals may refer to the same feature, element or component in the different drawings.

Unless otherwise indicated, the terms "first," "second," etc. are used herein merely as labels, and are not intended to impose ordinal, positional or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the phrase "at least one of," when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example and without limitation, two of item A, one of item B, and ten of item C; four of item B and seven of item C; or some other suitable combination.

Reference herein to "example," "one example," "another example," or similar language means that one or more feature, structure, element, component or characteristic described in connection with the example is included in at least one embodiment or implementation. Thus, the phrases "in one example," "as one example," and similar language throughout the present disclosure may, but do not necessarily, refer to the same example. Further, the subject matter characterizing any one example may, but does not necessarily, include the subject matter characterizing any other example.

Illustrative, non-exhaustive examples, which may be, but are not necessarily, claimed, of the subject matter according the present disclosure are provided below.

Figure 2:
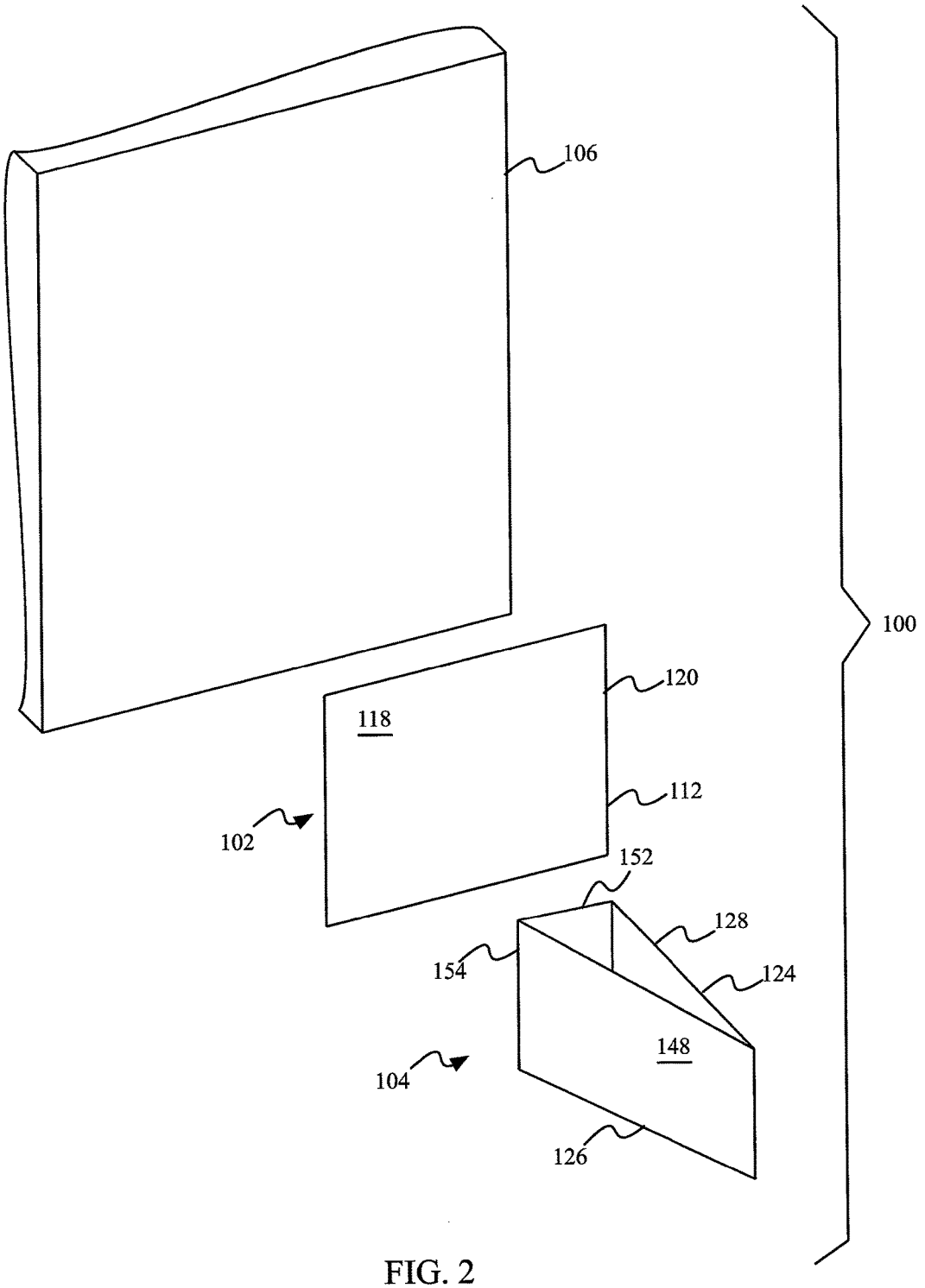
FIG. 2 is a schematic exploded isometric view of one example of the disclosed display system.

Referring to FIGS. 1 and 2, one example of the disclosed display system, generally designated system 100, may include a decal 102 and a folded display 104. Decal 102 may be removably attachable to a support surface 106. Folded display 104 may be permanently attachable to decal 102.

Generally, system 100, including decal 102 and folded display 104, may be referred to as or form a placard advertisement or display. System 100 may allow decal 102 to be easily attached to support surface 106 and folded display 104 to be easily attached to decal 102. When the time comes to remove or replace folded display 104, system 100 may allow decal 102 to be easily removed and, thus, also removing folded display 104.

System 100 may be used as a preprinted advertising display. In one example, decal 102 is used as the preprinted advertising display. In another example, folded display 104 is used as the preprinted advertising display. In yet another example, both decal 102 and folded display 104 are used as the preprinted advertising display. As illustrated in FIG. 1, indicia 108 (e.g., preprinted indicia) may be disposed on one or more display surfaces 110 of decal 102, folded display 104, or both decal 102 and folded display 104. Indicia 108 may include text, graphics and the like, and may represent advertising material, informational material and the like. Indicia 108 displayed on decal 102 may be identical to indicia 108 displayed on folded display 104. Alternatively, indicia 108 displayed on decal 102 may be different from indicia 108 displayed on folded display 104.

System 100 may be mounted or otherwise attached to a suitable support surface 106. In one example, decal 102 is removably attached to support surface 106 and folded display 104 is permanently attached to decal 102. Support surface 106 may be a portion of a surface of any suitable structure where the preprinted placard advertisement is desired. As one example, support surface 106 is a surface on a gasoline pump at a filling station. As another example, support surface 106 is a surface of a cooler or freezer door in a retail store. As yet another example, support surface 106 is a surface of a shelf or a display stand in a retail store.

Figure 5:
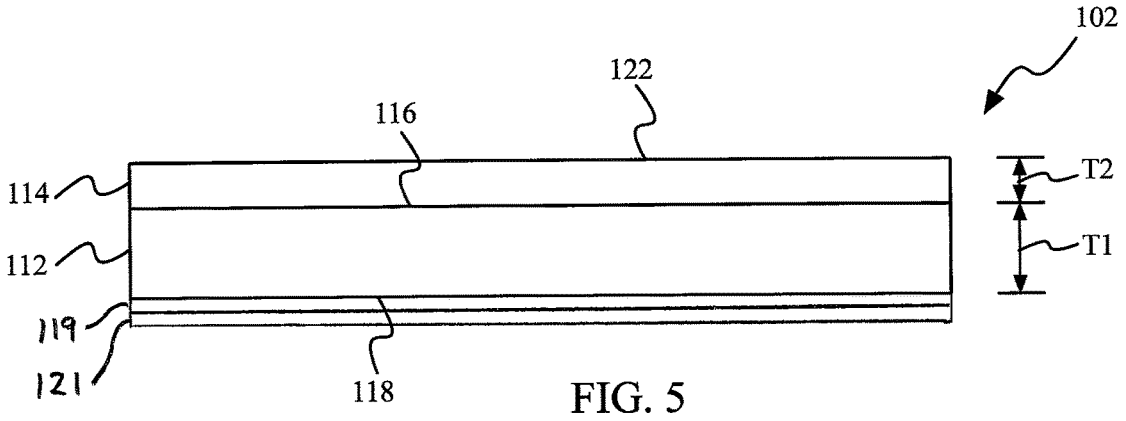
FIG. 5 is a schematic top plan view of the decal of the display system of FIG. 4.

Referring to FIG. 5, and with reference to FIGS. 1 and 2, decal 102 may include substrate layer 112 (e.g., a substrate body) and removable adhesive layer 114. Substrate layer 112 may include first (e.g., rear) surface 116 and second (e.g., front) surface 118 opposite first surface 116. Substrate layer 112 may include perimeter edge 120 (FIG. 2), for example, defining a peripheral shape of decal 102. As one example, and as illustrated in FIGS. 1 and 2, perimeter edge 120 may define a rectangular shape. As another example, perimeter edge 120 may define a square shape. As another example, perimeter edge 120 may define a circular shape. As yet another example, perimeter edge 120 may define an ovular shape. Any other geometric shape defined by perimeter edge 120 is also contemplated.

Substrate layer 112 may include thickness T1. As non-limiting examples, thickness T1 of substrate layer 112 may range from approximately 2 mils to approximately 40 mils. Removable adhesive layer 114 may include thickness T2. As non-limiting examples, thickness T2 of removable adhesive layer 114 may range from approximately 2 mils to approximately 20 mils.

Removable adhesive layer 114 may be applied to or otherwise disposed on first surface 116. The outwardly facing orientation of removable adhesive layer 114 may facilitate attachment (e.g., removable adhesive bonding) of decal 102 to support surface 106. Second surface 118 may serve as display surface 110 (FIG. 1). As one example, indicia 108 is printed, etched, embossed, painted, drawn, written or otherwise disposed on or applied to second surface 118.

Substrate layer 112 may be made from any suitable material upon which removable adhesive layer 114 and/or indicia 108 may be applied. Substrate layer 112 may be a polymeric substrate material. As one general, non-limiting example, substrate layer 112 is made of vinyl. As one specific, non-limiting example, substrate layer 112 is a vinyl film. Substrate layer 112 may be a non-polymeric substrate material. As one general, non-limiting example, substrate layer 112 is made of paper. As another general, non-limiting example, substrate layer 112 is made of fiberboard. Other substrate materials are also contemplated.

An ink layer 119 may be applied to the second surface 118 of the substrate layer 112. The ink layer 119 may cover all, or only a portion of, the second surface 118 of the substrate layer 112. The ink layer 119 may define indicia 108. Compositionally, the ink layer 119 may include any suitable marking composition, such as acrylic ink, vinyl ink, toner or the like.

An overcoat layer 121 may be applied over the ink layer 119 such that the ink layer 119 is positioned between the substrate layer 112 and the overcoat layer 121. The overcoat layer 121 may cover all, or only a portion of, the second surface 118 of the substrate layer 112. For example, the overcoat layer 121 may cover substantially all of the second surface 118 of the substrate layer 112, with the exception that all or a portion of the area contained within the position marker 162 (FIG. 8; discussed in greater detail herein) may be substantially free of the overcoat layer 121 such that the overcoat layer 121 does not compromise subsequent adhesive bonding within the position marker 162.

The overcoat layer 121 may include an overcoat material that forms a protective (e.g., weather resistant) coating over the second surface 118 of the substrate layer 112 to protect the underlying ink layer 119. As one general, non-limiting example, the overcoat material of the overcoat layer 121 may be (or may include) an ultraviolet light-curable acrylic clear coating. As another general, non-limiting example, the overcoat material of the overcoat layer 121 may be (or may include) a heat-curable acrylic clear coating. As yet another general, non-limiting example, the overcoat material of the overcoat layer 121 may be (or may include) an aqueous clear coating.

Removable adhesive layer 114 may be applied to first surface 116 of substrate layer 112 to removably attach decal 102 to support surface 106. As non-limiting examples, removable adhesive layer 114 may include (e.g., take the form of) adhesive tape (e.g., double sided tape), adhesive paste, adhesive film, adhesive spray or another chemically bonded adhesive. Removable adhesive layer 114 may be applied to at least a portion of first surface 116. As one example, removable adhesive layer 114 is applied to at least approximately fifty percent of a surface area of first surface 116. As another example, removable adhesive layer 114 is applied to at least approximately seventy-five percent of the surface area of first surface 116. As another example, removable adhesive layer 114 is applied to at least approximately ninety percent of the surface area of first surface 116. As yet another example, removable adhesive layer 114 is applied to an entirety (e.g., approximately one-hundred percent) of the surface area of first surface 116.

Removable adhesive layer 114 may include (e.g., may be formed by) removable adhesive material 122 for removably attaching substrate layer 112 to support surface 106. Removable adhesive material 122 may be configured to form a permanent bond with first surface 116 of substrate layer 112 and form a temporary bond with support surface 106 when brought into contact with one another. Removable adhesive material 122 may be a solvent adhesive, an acrylic adhesive or the like. As one example, removable adhesive material 122 includes a low tack adhesive.

As used herein the term low tack adhesive refers to an adhesive material that has a relatively low sticking strength or adhesive strength rating and/or requires a relatively low maximum tack force (also referred to as tack strength or pull force) to separate the bonded surfaces (e.g., between first surface 116 of substrate layer 112 and support surface 106). As one non-limiting example, the low tack adhesive (e.g., removable adhesive material 122) includes a strength rating of between approximately 1.0 $lb/in^2$ and approximately 2.0 $lb/in^2$. As another non-limiting example, the low tack adhesive includes a strength rating of approximately 1.5 $lb/in^2$.

As used herein the term low tack adhesive also refers to an adhesive material that leaves very little adhesive residue when removed. As one non-limiting example, the low tack adhesive (e.g., removable adhesive material 122) leaves less than approximately twenty percent adhesive residue upon separation of the bonded surfaces (e.g., on support surface 106 when substrate layer 112 is removed from support surface 106). As another non-limiting example, the low tack adhesive leaves less than approximately fifteen percent adhesive residue upon separation of the bonded surfaces. As another non-limiting example, the low tack adhesive leaves less than approximately ten percent adhesive residue upon separation of the bonded surfaces. As another non-limiting example, the low tack adhesive leaves less than approximately five percent adhesive residue upon separation of the bonded surfaces.

As another example, removable adhesive material 122 includes a very low tack adhesive. As used herein, the term very low tack adhesive refers to an adhesive material that allows the substrate to be easily lifted away from the support surface and moved to another position or another support surface without leaving residue and without destroying the ability to move and reapply the substrate again.

As one specific, non-limiting example, removable adhesive material 122 may be (or may include) 3M™ Removeable Repositionable Tape 9415PC, which is commercially available from 3M Company of St. Paul, Minn. 3M™ Removeable Repositionable Tape 9415PC is a double-sided tape that includes a high tack acrylic adhesive (3M™ 400 acrylic adhesive) on one side of a carrier film and a low tack repositionable acrylic adhesive (3M™ 1000 series repositionable acrylic adhesive) on the other side of the carrier film. The high tack acrylic adhesive side of the 3M™ Removeable Repositionable Tape 9415PC may be bonded to the first surface 116 of the substrate layer 112, thereby exposing the low tack repositionable acrylic adhesive of the 3M™ Removeable Repositionable Tape 9415PC for bonding to the support surface 106.

Figure 6:
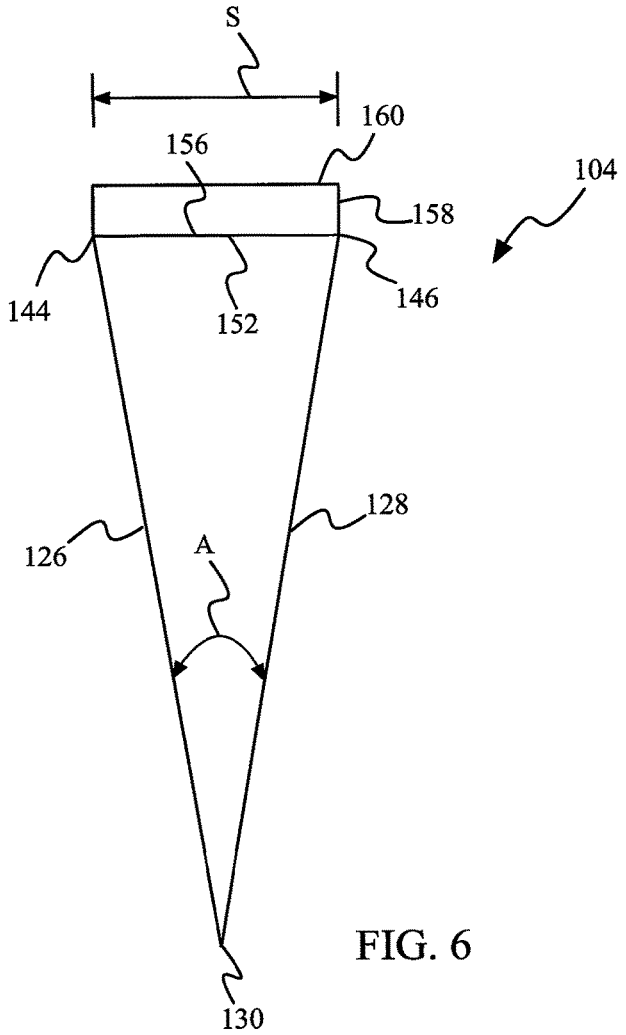
FIG. 6 is a schematic top plan view of the folded display of the display system of FIG. 4.
Figure 7:
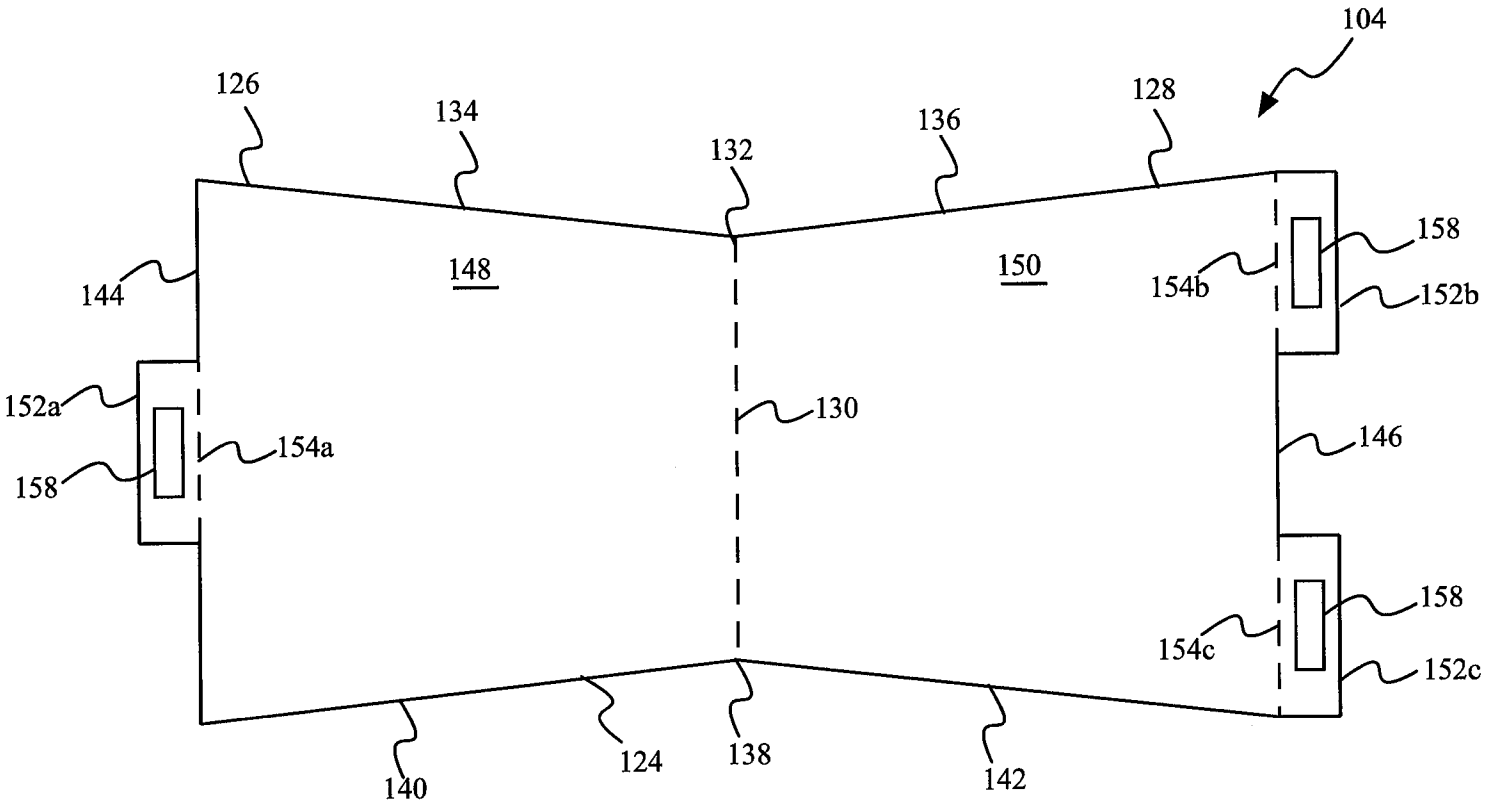
FIG. 7 is an elevational view of another example of a folded display of the disclosed display system, shown in a pre-assembled configuration.

Referring to FIGS. 6 and 7, and with reference to FIGS. 1 and 2, folded display 104 may include substrate body 124 defining first (e.g., left side) panel 126 and second (e.g., right side) panel 128. Seam 130 may extend laterally (e.g., vertically) through a middle portion of substrate body 124 between first panel 126 and second panel 128. Therefore, seam 130 may divide substrate body 124 generally in half, such that first panel 126 and second panel 128 may be generally identical in size and shape.

Substrate body 124 may be made of any suitable material that may maintain its shape and upon which indicia 108 may be applied. Substrate body 124 may be a polymeric substrate, for example, capable of withstanding outdoor conditions. As one general, non-limiting example, substrate body 124 is made of polymeric corrugated board. As one specific, non-limiting example, substrate body 124 is a polymer-based, extruded twinwall corrugated board produced from high-impact polypropylene resin, such as COROPLAST® board available from Coroplast, Inc. of Dallas, Tex. Substrate body 124 may be a non-polymeric material. As one general, non-limiting example, substrate body 124 is made of paper. As another general, non-limiting example, substrate body 124 is made of fiberboard. Other materials are also contemplated. Optionally, substrate body 124 may be laminated or otherwise coated with a protective (e.g., weather resistant) coating (not explicitly illustrated).

Substrate body 124 may include a corrugated substrate, for example, having an interior fluted corrugated sheet interposed between a first linerboard and a second linerboard (e.g., between opposed face sheets). Examples of the corrugated substrate of the substrate body are disclosed in U.S. Pat. No. 8,763,288 to Emoff, the entire contents of which are incorporated herein by reference.

Substrate body 124 of folded display 104 may be formed by any formation process now known or later developed, such as die-cutting a blank of the substrate material in accordance with cutting processes known in the art. Substrate body 124 may be formed to include various shapes and/or sizes. In one example, substrate body 124 is folded about seam 130 to form first panel 126 and second panel 128 of folded display 104. Seam 130 may be formed by at least partially scoring or perforating substrate body 124. Alternatively, seam 130 may be formed by an indentation or crease along substrate body 124. As another example, substrate body 124 is formed by connecting (e.g., hingedly connecting) first panel 126 and second panel 128 about seam 130. Seam 130 may be formed by any process now known or later developed for attaching or otherwise connecting separate panels of substrate material along opposing and aligned edges.

Referring to FIG. 7, in one example, seam 130 is generally straight, and extends approximately vertically from first point 132 of substrate body 124 (e.g., where top edge 134 of first panel 126 meets top edge 136 of second panel 128) to a laterally opposed second point 138 of substrate body 124 (e.g., where bottom edge 140 of first panel 126 meets bottom edge 142 of second panel 128). In another example, seam 130 extends only partially through substrate body 124 (e.g., may not extend all the way to first point 132 or second point 138).

Thus, in one example, first panel 126 is defined by seam 130, top edge 134, bottom edge 140 and side edge 144. Similarly, in one example, second panel 128 is defined by seam 130, top edge 136, bottom edge 142 and side edge 146. As illustrated in FIG. 6, once substrate body 124 is folded along seam 130, seam 130 forms (e.g., defines) a front edge of folded display 104, side edge 144 forms a first rear edge of folded display 104 and side edge 146 forms an opposing second rear edge of folded display 104.

While the examples of folded display 104 illustrated in the figures depict first panel 126 and second panel 128 as each having four (4) sides, in other examples, first panel 126 and/or second panel 128 may have any number of sides and/or any geometric shape. Additionally, while the examples of top edges 134 and 136, bottom edges 140 and 142, and side edges 144 and 146 are illustrated in the figures as being approximately straight, in other examples, any one or more of these edges may be wavy, or curved, depending on the type and/or overall shape of folded display 104.

Referring to FIG. 7, and with reference to FIG. 6, first panel 126 may include first face 148 (e.g., front surface) that is generally outwardly facing and viewable when substrate body 124 is folded about seam 130 and displayed in a manner in accordance with example illustrated in FIG. 6. Similarly, second panel 128 may include second face 150 (e.g., front surface) that is generally outwardly facing and viewable when substrate body 124 is folded about seam 130 and displayed in a manner in accordance with example illustrated in FIG. 6

Referring to FIG. 7, and with reference to FIGS. 1 and 6, at least one of first face 148 and second face 150 may serve as display surface 110 (FIG. 1). As one example, indicia 108 (FIG. 1) is printed, etched, embossed, painted, drawn, written or otherwise disposed on or applied to first face 148 and/or second face 150.

Referring to FIG. 6, and with reference to FIG. 2, folded display 104 may include at least one tab 152. Tab 152 may extend outwardly from at least one side edge (e.g., side edge 144 and/or side edge 146) of substrate body 124. Tab 152 may be affixed to, integral to or otherwise attached to substrate body 124. Tab 152 may extend generally beyond a peripheral boundary of substrate body 124 defined by at least one side edge. As illustrated in FIG. 6, when substrate body 124 is folded along seam 130 and viewed from the top, folded display 104 may appear generally triangular in shape. Once substrate body 124 is folded along seam 130, tab 152 forms (e.g., defines) rear surface 156 of folded display 104.

In examples where tab 152 is integrally formed as a part of substrate body 124, tab 152 may be defined by at least one tab fold line 154 (FIG. 2). Tab fold line 154 may extend from proximate (e.g., at or near) a top edge of tab 152 to proximate a bottom edge of tab 152. Tab fold line 154 may be collinear with at least one side edge in such a way that tab fold line 154 allows tab 152 to be easily folded at a non-zero angle relative to the panel along the tab fold line 152. Tab fold line 152 may be formed by scoring, perforating, indenting, creasing or folding an area of the substrate body 124 between tab 152 and an associated one of the panels along the side edge.

Referring to FIG. 7, and with reference to FIG. 6, in one example, folded display 104 includes a plurality of tabs 152 extending outwardly from the opposed side edges of substrate body 124. First (e.g., middle) tab 152*a* may extend generally beyond the boundary defined by side edge 144 of first panel 126. First tab 152*a* may be located at an approximate middle or central portion of side edge 144 of first panel 126. First tab 152*a* may be defined by first tab fold line 154*a* that is collinear with side edge 144 in such a way that first tab fold line 154*a* allows first tab 152*a* to be easily folded relative to first panel 126 along first tab fold line 154*a*. Second (e.g., top) tab 152*b* may extend generally beyond the boundary defined by side edge 146 of second panel 128. Second tab 152*b* may be located at an approximate top of side edge 146 of second panel 126 (e.g., extending away from top edge 136 toward bottom edge 142). Second tab 152*b* may be defined by second tab fold line 154*b* that is collinear with side edge 146 in such a way that second tab fold line 154*b* allows second tab 152*b* to be easily folded relative to second panel 128 along second tab fold line 154*b*. Third (e.g., bottom) tab 152*c* may extend generally beyond the boundary defined by side edge 146 of second panel 128. Third tab 152*c* may be located at an approximate bottom of side edge 146 of second panel 126 (e.g., extending away from bottom edge 142 toward top edge 136). Third tab 152*c* may be defined by third tab fold line 154*c* that is collinear with side edge 146 in such a way that third tab fold line 154*c* allows third tab 152*c* to be easily folded relative to second panel 128 along third tab fold line 154*c*.

In one example, when substrate body 124 is folded to form folded display 104, first tab 152*a* may be positioned adjacent to and between second tab 152*b* and third tab 152*c*. The three tabs 152*a*, 152*b* and 152*c* in combination may form (e.g., define) rear surface 156 of folded display 104.

In another example, when substrate body 124 is folded to form folded display 104, first tab 152*a* may be positioned in such a way that it joins with second tab 152*b* and third tab 152*c*. The three tabs 152*a*, 152*b* and 152*c* may be joined together in such a way that they precisely align with each other in an interlocking manner, such as a tongue-and-groove fashion, thereby fixing a position (e.g., angular orientation) of first panel 126 and second panel 128 relative to each other. The three tabs 152*a*, 152*b* and 152*c* in combination may form (e.g., define) rear surface 156 of folded display 104.

In yet another example, folded display 104 includes at least one (e.g., a first) tab 152 extending outwardly from side edge 144 of first panel 126 and at least one other (e.g., a second) tab 152 extending outwardly from side edge 146 of second panel 128. A first one of tabs 152 extending from and associated with first panel 126 may be generally aligned with a second one of tabs 152 extending from and associated with second panel. Each one of tabs 152 may include a contoured edge opposite an associated side edge. The contoured edge of the first one of tabs 152 may be curved in such a way that the hills and valleys of the contoured edge are an inverse of the hills and valleys of the corresponding contoured edge of the second one of tabs 152. When substrate body 124 is folded to form folded display 104 and tabs 152 are folded along their respective tab fold lines, the contoured edge of the first one of tabs 152 mates with the contoured edge of the second one of tabs and forms a fitted, interlocking engagement, thereby fixing the position (e.g., angular orientation) of first panel 126 and second panel 128 relative to each other. The tabs 152 in combination may form (e.g., define) rear surface 156 (FIG. 6) of folded display 104.

Other examples of interlocking tabs 152 are also contemplated. Examples of interlocking tabs are also disclosed in U.S. Pat. No. 8,763,288 to Emoff.

Referring to FIG. 6, and with reference to FIGS. 1-4 and 7, the approximate triangular shape of folded display 104 may be due to spacing S (e.g., a linear dimension) between side edge 144 of first panel 126 opposing side edge 146 of second panel 128. Spacing S, a length of first panel 126 (e.g., a linear dimension between side edge 144 and seam 130) and a length of second panels 128 (e.g., a linear dimension between side edge 146 and seam 130) may dictate a non-zero angle A defined between first panel 126 and second panel 128, and also a non-zero angle defined between first panel 126 (e.g., first face 148) and second panel 128 (e.g., second face 150) relative to support surface 106. In one non-limiting example, spacing S is at least approximately one-half (0.5) inch (1.27 cm). In another non-limiting example, spacing S is at least approximately one (1) inch (2.54 cm). In another non-limiting example, spacing S is at least approximately one and half (1.5) inches (3.81 cm). In yet another non-limiting example, spacing S is at least approximately two (2) inches (5.08 cm). A smaller and a larger spacing S are also contemplated. A larger spacing S may allow for a larger rear surface 156 of folded display 104 formed by the one or more tabs 152. The larger rear surface 156 of folded display 104 available may provide a larger surface area for any adhesive and, hence, greater adhesion of folded display 104 to decal 102.

Referring to FIG. 6, and with reference to FIGS. 1-4, folded display 104 may include permanent adhesive layer 158 applied to tabs 152 to permanently attach (e.g., affix) folded display 104 to decal 102. As non-limiting examples, permanent adhesive layer 158 may include (e.g., take the form of) adhesive tape (e.g., double sided tape), adhesive paste, adhesive film, adhesive spray or another chemically bonded adhesive.

Referring to FIG. 7, and with reference to FIGS. 1-4 and 6, permanent adhesive layer 158 may be positioned in such a way that when substrate body 124 is folded along seam 130 and tabs 152 (e.g., first tab 152*a*, second tab 152*b* and third tab 152*c*) are folded along respective tab fold lines 154 (e.g., first tab fold line 154*a*, second tab fold line 154*b* and third tab fold line 154*c*), permanent adhesive layer 158 faces outwardly (e.g., toward decal 102). The outwardly facing orientation of permanent adhesive layer 158 may facilitate attachment (e.g., permanent adhesive bonding) of folded display 104 to decal 102. Attachment of tabs 152 to second surface 118 of decal 102 may fix the position (e.g., angular orientation) of first panel 126 and second panel 128 relative to each other, and, thus a position (e.g., angular orientation) of first face 148 and second face 150 relative to support surface 106.

Permanent adhesive layer 158 may be applied to at least a portion of a surface of each one of tabs 152 that will come into contact with second surface 118 of decal 102. While the example illustrated in FIG. 7 depicts permanent adhesive layer 158 as being formed by one adhesive area covering (e.g., an adhesive patch affixed to) a portion of the surface of each one of tabs 152*a*, 152*b* and 152*c*, other configurations of permanent adhesive layer 158 are also contemplated. Furthermore, the size and/or shape of permanent adhesive layer 158 may be any suitable size and/or shape. The size and/or shape of particulars portion of permanent adhesive layer 158 may vary on the same folded display 104. Permanent adhesive layer 158 may be applied to at least a portion of the outwardly facing surface of each tab 152. As one example, permanent adhesive layer 158 is applied to at least approximately fifty percent of a surface area of tab 152. As another example, permanent adhesive layer 158 is applied to at least approximately seventy-five percent of the surface area of tab 152. As another example, permanent adhesive layer 158 is applied to at least approximately ninety percent of the surface area of tab 152. As yet another example, permanent adhesive layer 158 is applied to an entirety (e.g., approximately one-hundred percent) of the surface area of tab 152.

Referring to FIG. 6, permanent adhesive layer 158 may include (e.g., may be formed by) permanent adhesive material 160 for permanently attaching folded display 104 to decal 102. Permanent adhesive material 160 may be configured to form a permanent bond with the surface of tab 152 and form a permanent bond with second surface 118 of decal 102 when brought into contact with one another. As one example, permanent adhesive material 160 includes a high tack adhesive. As one general, non-limiting example, permanent adhesive material 160 is a high strength, pressure sensitive permanent adhesive. As one specific, non-limiting example, permanent adhesive material 160 is VHB RP45 adhesive tape provided by 3M Company.

Optionally, the surface of tabs 152 may be flood printed with an ink or other coating to which the permanent adhesive layer 158 may be applied. Examples of the coated surfaces of the substrate body are also disclosed in U.S. Pat. No. 8,763,288 to Emoff.

One particular advantage or benefit provided by the disclosed system 100 is the ability to securely and removably (e.g., temporarily) attach decal 102 to support surface 106 using a relatively inexpensive removable adhesive, and then securely and permanently attaching folded display 104 to decal 102 by the use of a relatively inexpensive permanent adhesive. Another particular advantage or benefit provided by the disclosed system 100 is the ability to simply and easily remove both decal 102 and folded display 104 from support surface 106 without leaving excessive amounts of adhesive residue on support surface 106.

Figure 3:
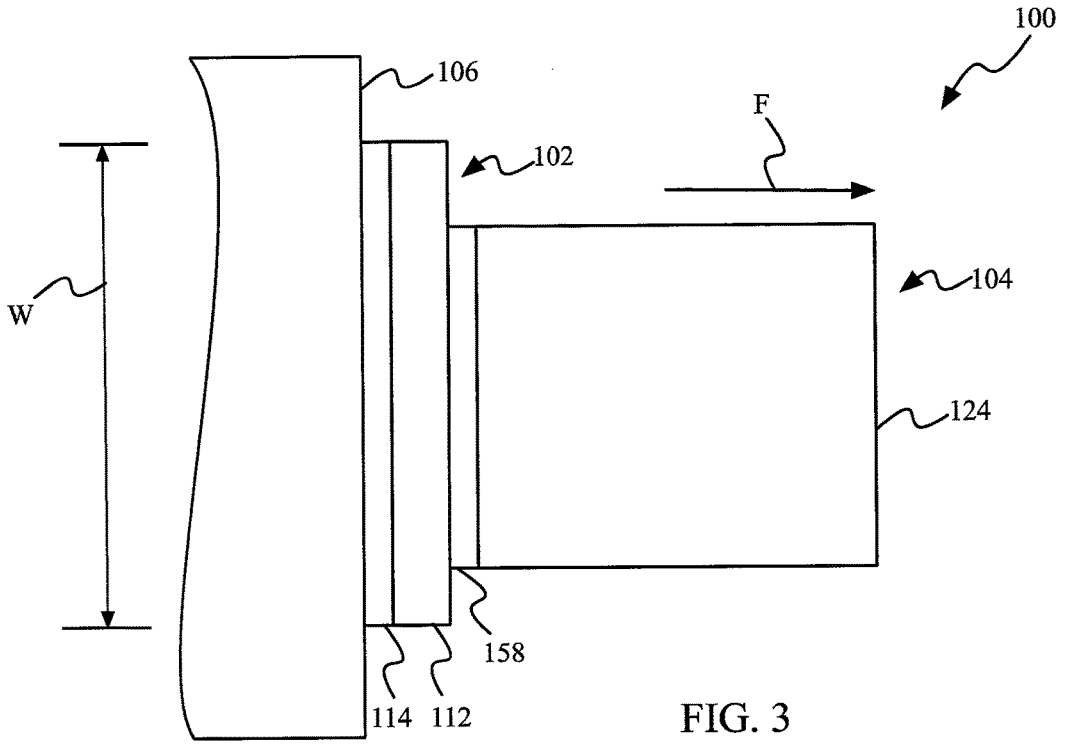
FIG. 3 is a schematic side elevation view of one example of the disclosed display system.
Figure 4:
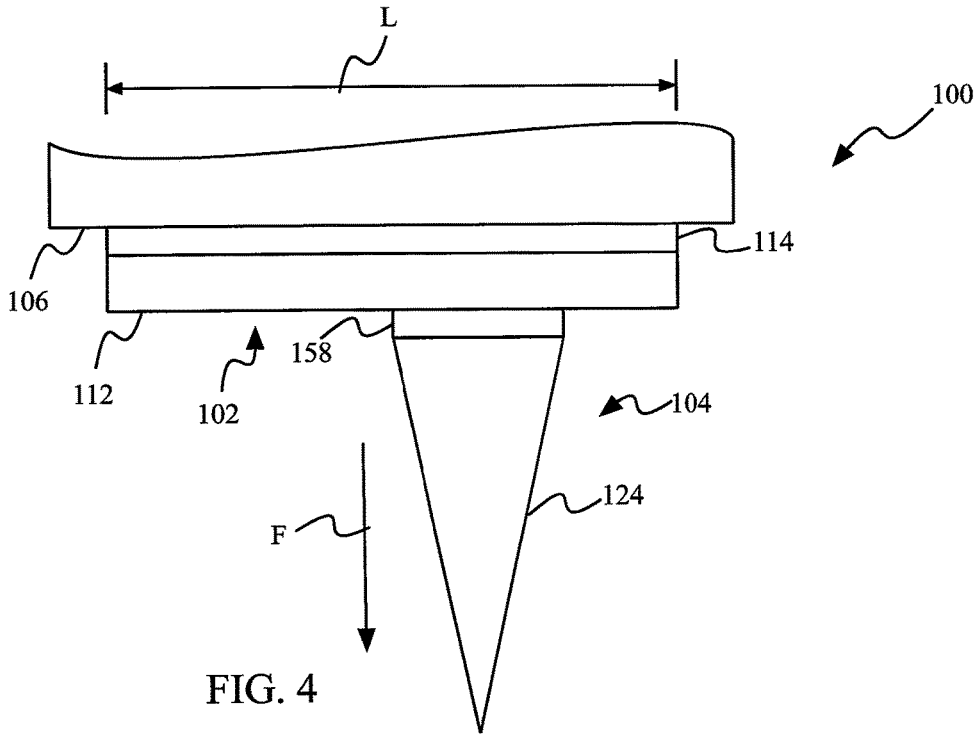
FIG. 4 is a schematic top plan view of one example of the disclosed display system.

Referring to FIGS. 3 and 4, and with reference to FIGS. 1 and 2, decal 102 may include first (e.g., vertical or width) dimension W and second (e.g., horizontal or length) dimension L defined by perimeter edge 120 (FIG. 2) of substrate layer 112. First dimension W and second dimension L may be suitably sized to provide a sufficient surface area such that the adhesive strength of removable adhesive layer 114 is sufficient to resist pulling force F created by the attachment of folded display 104 to decal 102, and, thus, secures both decal 102 and folded display 104 to support surface 106.

Figure 8:
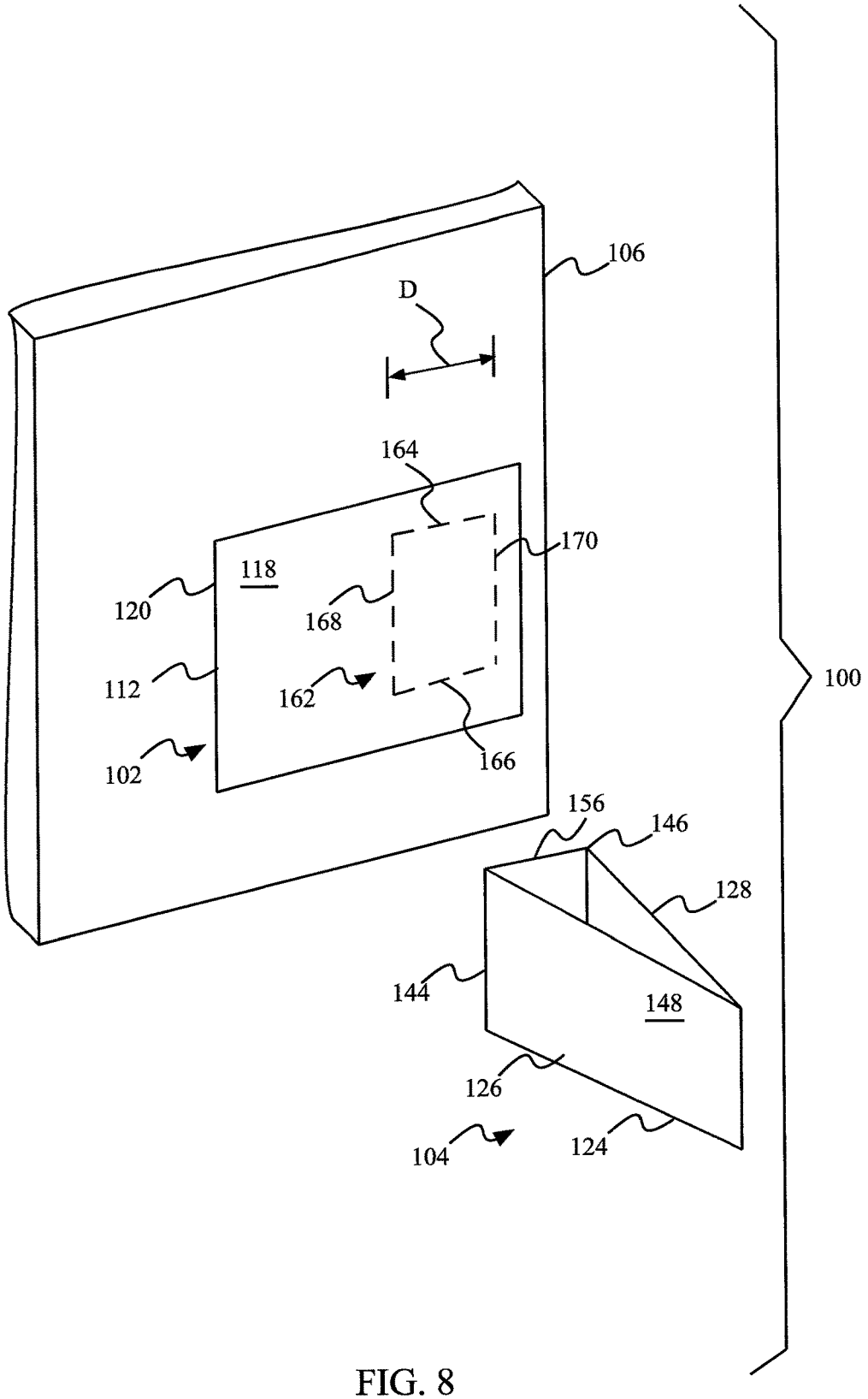
FIG. 8 is a schematic partially exploded isometric view of one example of the disclosed display system.

Referring to FIG. 8, and with reference to FIGS. 1, 3, 4 and 7, decal 102 may include position marker 162. Position marker 162 may be printed, painted, drawn, embossed, written or otherwise directly applied to or disposed on second surface 118 of substrate layer 112. Position marker 162 may serve as a guide to properly position folded display 104 relative to decal 102 when attaching folded display 104 to decal 102, as illustrated in FIG. 1. In other words, position marker 162 may set a vertical and/or horizontal position of folded display 104. Position marker 162 may also facilitate accurate application (e.g., square alignment) of folded display 14 to decal 102.

Position marker 162 may include at least one of top marker line 164, bottom marker line 166, first side marker line 168 and second side marker line 170. Position marker 162 may include a size and/or shape approximately matching a size and/or shape of at least a portion of a perimeter of rear surface 156 of folded display 104, for example, as defined by opposed top edges 134 and 136, opposed bottom edges 140 and 142, and opposed side edges 144 and 146. Top marker line 164 and bottom marker line 166 may be spaced away from each other. In one example, top marker line 164 and bottom marker line 166 are approximately parallel. First side marker line 168 and second side marker line 170 may be spaced away from each other. In one example, first side marker line 168 and second side marker line 170 are approximately parallel.

Top marker line 164 may be aligned with and position a top edge of folded display 104 (e.g., formed by top edge 134 of first panel 126 and top edge 136 of second panel 128) relative to decal 102. As one example, a corner of first panel 126 formed by top edge 134 and side edge 144 is positioned proximate (e.g., at or near) top marker line 164 and a corner of second panel 128 formed by top edge 136 and side edge 146 is positioned proximate top marker line 164.

Bottom marker line 166 may be aligned with and position a bottom edge of folded display 104 (e.g., formed by bottom edge 140 of first panel 126 and bottom edge 142 of second panel 128) relative to decal 102. As one example, another corner of first panel 126 formed by bottom edge 140 and side edge 144 is positioned proximate bottom marker line 164 and a corner of second panel 128 formed by top edge 136 and side edge 146 is positioned proximate top marker line 164.

First side marker line 168 may be aligned with and position side edge 144 of folded display 104 relative to decal 102. As one example, side edge 144 of first panel 126 is positioned proximate and approximately parallel to first side marker line 168.

Second side marker line 170 may be aligned with and position side edge 146 of folded display 104 relative to decal 102. As one example, side edge 146 of second panel 128 is positioned proximate and approximately parallel to second side marker line 170.

Referring to FIG. 8, and with reference to FIG. 6, position marker 162 may also facilitate application of folded display 104 to decal 102 at a predetermined or fixed angle A (FIG. 6) between first panel 126 and second panel 128. First side marker line 168 and second side marker line 170 may be spaced apart by dimension D. Dimension D between first side marker line 168 and second side marker line 170 may set spacing S (FIG. 6) between side edge 144 of first panel 126 and side edge 146 of second panel 128, thereby defining the positions of side edge 144 and side edge 146 relative to each other and angle A between first panel 126 and second panel 128 (and first face 148 and second face 150 relative to support surface 106).

One particular advantage or benefit provided by the disclosed system 100 is that folded display 104 may use smaller tabs 152 that do not need to engage one another or even be proximate to one another in order to apply folded display 104 having a desired angle A between first panel 126 and second panel 128. In such a manner, folded display 104 may not need interlocking tabs 152, as described herein, as a way to set the angular orientation of first panel 126 and second panel 128 relative to each other.

Figure 9:
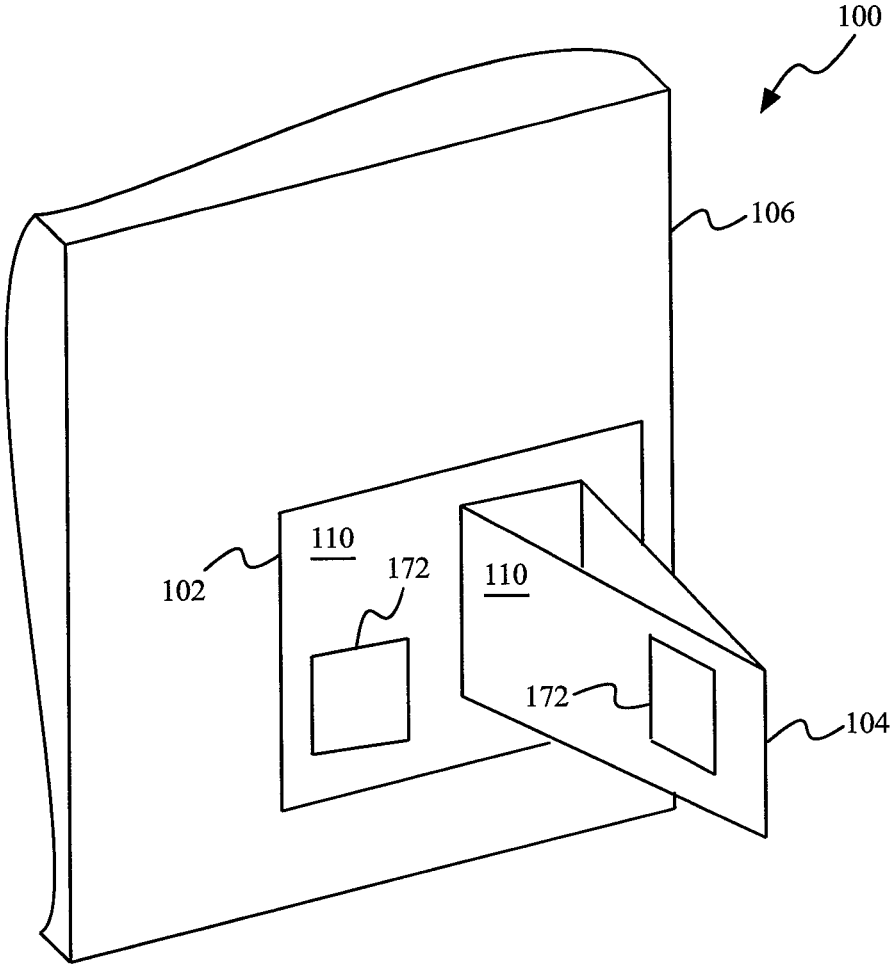
FIG. 9 is a schematic isometric view of another example of the disclosed display system.

Referring to FIG. 9, in addition to the indicia 108 (FIG. 1), one or more of first panel 126, second panel 128 and decal 102 may include additional advertising or informational dispensing devices 172 attached to a portion of their respective display surface 110. Dispensing device 172 may include dispensers, pockets, sleeves, and the like. Dispensing device 172 may include an adhesive-coated back surface suitable for attachment to first face 148 of first panel 126, second face 150 of second panel 128 and/or second surface 118 of decal 102.

Examples of dispensing device 172 are disclosed in U.S. Patent Pub. No. 2006/0011643 to Emoff et al., the entire contents of which are incorporated herein by reference. The Emoff publication discloses a disposable coupon dispenser that is particularly suitable for use outdoors because of water-resistant properties of the dispenser and the coupons.

Although various examples of the disclosed display system have been shown and described, modifications may occur to those skilled in the art upon reading the specification. The present application includes such modifications and is limited only by the scope of the claims.

What is claimed is:

1. A display system comprising:
a decal comprising:
a substrate layer;
a removable adhesive layer coupled to said substrate layer and configured to removably attach said substrate layer to a support surface;
an ink layer coupled to said substrate layer opposite said removable adhesive layer; and
a position marker formed by said ink layer; and
a folded display and comprising:
a first panel and a second panel connected to said first panel along a seam;
a first tab connected to said first panel, opposite said seam, and attachable to said ink layer; and
a second tab connected to said second panel, opposite said seam, and attachable to said ink layer; and
wherein, with said first tab and said second tab aligned with said position marker, said position marker is configured to set an angular relation between said first panel and said second panel at a predetermined non-zero angle.

2. The system of claim 1 wherein:
said substrate layer comprises a first flat surface and a second flat surface opposite said first flat surface;
said removable adhesive layer comprises a removable adhesive material applied to at least a portion of said first flat surface of said substrate layer; and
said ink layer comprises ink applied to at least a portion of said second flat surface of said substrate layer.

3. The system of claim 2 wherein said substrate layer comprises a vinyl film.

4. The system of claim 2 wherein said removable adhesive material comprises a removable adhesive configured to leave less than twenty percent adhesive residue upon separation from the support surface.

5. The system of claim 2 wherein said substrate layer comprises paper.

6. The system of claim 1 wherein:
said first panel comprises a first side edge opposite said seam, and said first tab is connected to and extends from said first side edge;
said second panel comprises a second side edge opposite said seam, and said second tab is connected to and extends from said second side edge; and
a permanent adhesive layer is applied to said first tab and said second tab to permanently attach said folded display to said ink layer of said decal.

7. The system of claim 6 wherein, with said first tab and said second tab aligned with said position marker and attached to said ink layer of said decal, said first tab and said second tab are spaced away from one another.

8. The system of claim 1 wherein:
said decal further comprises an overcoat layer covering a first portion of said ink layer;
said position marker is formed by a second portion of said ink layer that is not covered by said overcoat layer; and
said first tab and said second tab are attachable to said second portion of said ink layer within said position marker.

9. The system of claim 1 wherein:
said first panel comprises a first face and said second panel comprises a second face; and
at least one of said first face of said first panel and said second face of said second panel is marked with indicia.

10. A display system comprising:
a decal comprising:
a substrate layer comprising a first surface and a second surface opposite said first surface;

a layer of removable adhesive material applied to at least a portion of said first surface; and a layer of ink applied to at least a portion of said second surface; and a position marker formed by said layer of said ink and located on said second surface; and a folded display comprising:

a first panel connected to a second panel along a seam, said first panel comprising a first side edge opposite said seam, and said second panel comprising a second side edge opposite said seam;

a first tab connected to said first panel along said first side edge;

a second tab connected to said second panel along said second side edge; and a permanent adhesive material applied to at least a portion of said first tab and said second tab; and wherein:

said removable adhesive material is configured to form a temporary adhesive bond between said substrate layer and a support surface upon contact;

with said first tab and said second tab aligned with said position marker, said position marker is configured to set an angular orientation of said folded display at a predetermined vertical alignment and a predetermined horizontal alignment relative to said decal and to set an angular relation between said first panel and said second panel at a predetermined non-zero angle; and said permanent adhesive material is configured to form a permanent adhesive bond between said first tab and said second surface of said substrate layer and between said second tab and said second surface of said substrate layer upon contact.

11. The system of claim 10 wherein said removable adhesive material comprises a removable adhesive configured to leave less than twenty percent adhesive residue on said support surface upon removal of said decal.

12. The system of claim 10 wherein said decal further comprises a layer of overcoat material applied over a first portion of said layer of said ink, and wherein a second portion of said layer of said ink is substantially free of said overcoat material and defines said position marker.

13. The system of claim 10 wherein:

said position marker comprises a vertical marker line and a horizontal marker line; and with one of said first side edge or said second edge of said folded display aligned with said vertical marker line and said horizontal marker line, said folded display is set at said predetermined vertical alignment and said predetermined horizontal alignment relative to said substrate layer.

14. The system of claim 13 wherein:

said position marker further comprises a second vertical marker line that is spaced away from said vertical marker line; and with said first edge of said folded display aligned with said vertical marker line and said second edge of said folded display aligned with said second vertical marker line, said first tab and said second tab are spaced apart from one another and said angular relation between said first panel and said second panel is set at said predetermined non-zero angle.

15. The system of claim 10 wherein said removable adhesive material covers a sufficient surface area of said first surface of said substrate layer to resist a pulling force applied to said decal by said folded display.

16. The system of claim 10 wherein said removable adhesive material has an adhesive strength sufficient to resist a pulling force applied to said decal by said folded display.

17. The system of claim 10 wherein said first panel comprises a first face and said second panel comprises a second face, and wherein at least one of said first face of said folded display, said second face of said folded display, and said second surface of said substrate layer is marked with indicia.

18. The system of claim 10 further comprising a dispensing device connected to at least one of said first panel, said second panel, and said decal.

19. A display system comprising:

a decal comprising:

a substrate layer comprising a first surface and a second surface opposite said first surface;

a layer of removable adhesive material applied to at least a portion of said first surface; and a layer of ink applied to at least a portion of said second surface, a layer of overcoat material covering a first portion of said layer of said ink; and a position marker defined by a second portion of said layer of said ink that is not covered by said layer of said overcoat material; and a folded display comprising:

a first panel connected to a second panel along a seam, said first panel comprising a first side edge opposite said seam, and said second panel comprising a second side edge opposite said seam;

a first tab connected to said first panel along said first side edge;

a second tab connected to said second panel along said second side edge; and a permanent adhesive material applied to at least a portion of said first tab and said second tab; and wherein:

said layer of removable adhesive material is configured to form a temporary adhesive bond between said substrate layer and a support surface upon contact;

with said first tab and said second tab aligned within said position marker, said position marker is configured to set an angular relation between said first panel and said second panel to a predetermined non-zero angle; and said permanent adhesive material is configured to form a permanent adhesive bond between said first tab and said second portion of said layer of ink and between said second tab and said second portion of said layer of ink upon contact.

20. The system of claim 19 wherein:

said position marker comprises a first marker line and a second marker line spaced away from said first marker line; and with said first edge of said folded display aligned with said first marker line and said second edge of said folded display aligned with said second marker line, said first tab and said second tab are spaced apart from one another and said angular relation between said first panel and said second panel is set at said predetermined non-zero angle.

* * * * *